US007198555B2

(12) United States Patent
Dodge

(10) Patent No.: US 7,198,555 B2
(45) Date of Patent: Apr. 3, 2007

(54) ATOMIZER COOLING BY LIQUID CIRCULATION THROUGH ATOMIZER TIP HOLDER

(75) Inventor: Lee G. Dodge, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/321,855

(22) Filed: Dec. 29, 2005

(65) Prior Publication Data

US 2006/0163379 A1 Jul. 27, 2006

Related U.S. Application Data

(60) Provisional application No. 60/640,612, filed on Dec. 30, 2004.

(51) Int. Cl.
*B24C 5/04* (2006.01)

(52) U.S. Cl. ..... 451/102; 451/449; 239/125; 239/132; 239/132.5

(58) Field of Classification Search ..... 451/36, 451/38, 40, 102, 449; 239/103, 124, 125, 239/128, 132, 132.3, 132.5, 404, 405
See application file for complete search history.

(56) References Cited

U.S. PATENT DOCUMENTS

| | | | | | |
|---|---|---|---|---|---|
| 4,350,103 | A * | 9/1982 | Poll | 110/264 |
| 4,644,878 | A * | 2/1987 | Nodd et al. | 110/264 |
| 5,261,602 | A * | 11/1993 | Brent et al. | 239/132.3 |
| 5,346,133 | A * | 9/1994 | Bogner et al. | 239/132.3 |
| 5,515,794 | A * | 5/1996 | Kassman et al. | 110/261 |
| 6,042,019 | A * | 3/2000 | Rusch | 239/85 |
| 6,158,676 | A * | 12/2000 | Hughes | 239/405 |
| 6,775,984 | B2 * | 8/2004 | Lavie et al. | 60/740 |

OTHER PUBLICATIONS

"VARIFLO Pressure Atomizing Nozzles for good atomizing over a wide flow range", pp. 14-17.

* cited by examiner

*Primary Examiner*—Eileen P. Morgan
(74) *Attorney, Agent, or Firm*—Baker Botts, L.L.P.

(57) ABSTRACT

An improved atomizer, in which the liquid to be sprayed is circulated around the nozzle tip to prevent degradation of the liquid in hot environments. The circulation is controlled by a valve, which permits the liquid to circulate even when no liquid is being sprayed.

8 Claims, 2 Drawing Sheets

ATOMIZER COOLING BY LIQUID CIRCULATION THROUGH ATOMIZER TIP HOLDER

CROSS-REFERENCE TO RELATED APPLICATIONS

This application claims the benefit of U.S. Provisional Application No. 60/640,612 filed on Dec. 30, 2004, entitled "Atomizer Cooling by Liquid Circulation Through Atomizer Tip Holder", which is incorporated herein by reference in its entirety.

TECHNICAL FIELD OF THE INVENTION

The present invention relates to liquid spray devices, and more particularly to an improved atomizer.

BACKGROUND OF THE INVENTION

An "atomizer" is a dispenser that turns a liquid into a fine spray. For some applications, atomizers are used to spray a fuel or other liquid into a hot environment.

In the case of fuel atomizers, the fuel can undergo chemical changes leading to carbonaceous dry materials that plug the atomizer if the fuel temperature is not maintained below the thermal oxidation temperature, typically in the range of 200° C. to 300° C. This chemical degradation of the fuel due to thermal oxidation is often referred to as fuel "coking."

Similarly, in spraying urea-water mixtures into the exhaust of engines as part of a selective catalytic reduction (SCR) system for control of nitric oxide (NO) emissions, the atomizer can sometimes overheat and cause the water to vaporize, leaving behind solid urea particles that plug the atomizer.

In the design of fuel atomizers or other atomizers, the liquid flowing through the atomizer is also used to cool the atomizer and to avoid chemical changes in the liquid that can lead to atomizer plugging. However, in some applications, such as fuel injection atomizers, the atomization is intermittent. The atomizer remains in place in the hot environment when no liquid is flowing through the atomizer. Overheating of the liquid in the atomizer under these conditions can cause atomizer plugging and failure.

A solution to this problem can be achieved if the atomizer temperature can be maintained below the temperature at which the liquid undergoes thermal degradation. To cool the atomizer and avoid thermal decomposition, water or engine coolant is often used. However, routing cooling water to the atomizer is often difficult, expensive, or impractical.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The concept discussed herein is directed to an atomizer design that reduces the chance of atomizer plugging, whether the liquid being sprayed is fuel, urea-water mixtures, or some other liquid or liquid mixture that is subject to thermal degradation. This concept may be implemented as an improvement to an existing, commercially available atomizer. The concept reduces or eliminates the probability of thermal degradation of the liquid being sprayed, while extending the flow range of the atomizer.

Figure 1:
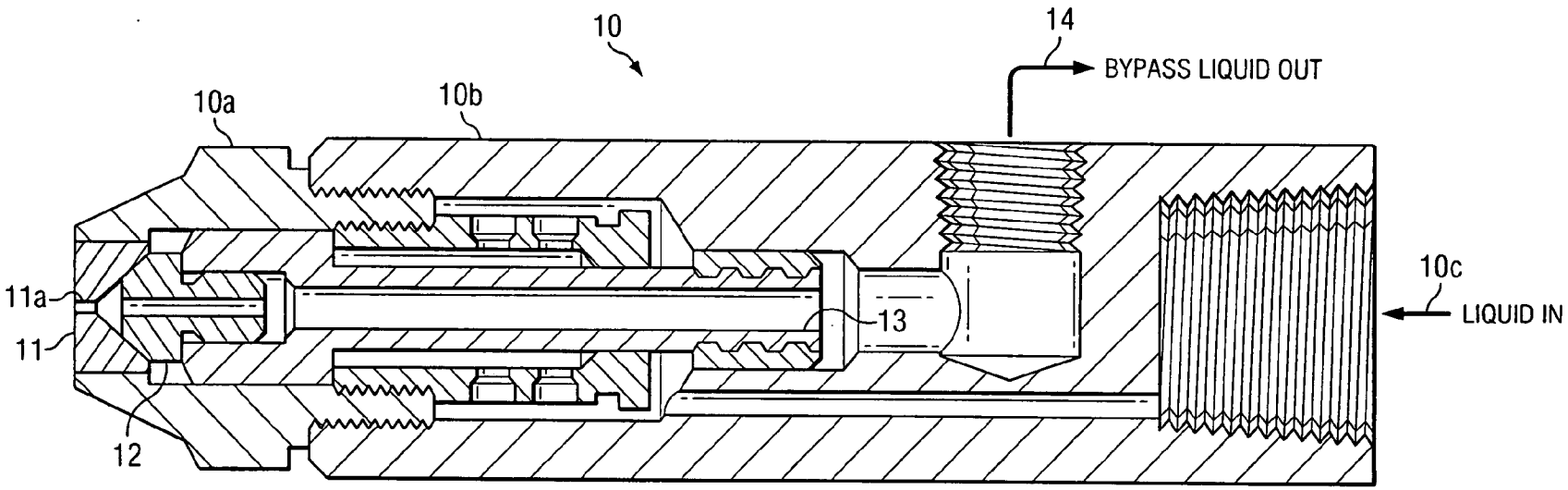
FIG. 1 illustrates a pressure-swirl atomizer with bypass.

FIG. 1 illustrates an example of the type of atomizer with which the invention may be used. This atomizer 10 is the commercially available pressure-atomized Variflo™ bypass nozzle, available from Delavan Spray Technologies. Atomizer 10 comprises a nozzle 10*a* screwed into an adapter 10*b*. In accordance with the bypass design of atomizer 10, with constant supply pressure at inlet 10*c* and with bypass channel 14 closed, the nozzle 10*a* operates as a simplex nozzle with the liquid being delivered via spray channel 13 and sprayed out from orifice 11*a*. With the bypass channel 14 open, part of the liquid is allowed to return to a source reservoir (not shown), with the result being reduced discharge flow.

The atomization principle of atomizer 10 is based on swirling the liquid in a swirl chamber just upstream of an orifice disk 11. As a result of the swirling, a thin sheet of liquid flows along the outer edges of the orifice disk 11. The liquid is then atomized as it leaves the orifice 11*a*. The swirling flow is created by narrow slots cut at an angle in the distributor 12.

As discussed in the Background, a limitation to any atomizer for applications in a hot environment is that when the spray is turned off, that is, when flow is stopped in the atomizer, the liquid remains in the tip and may be subject to thermal degradation. If the atomizer is then turned back on, the atomizer may then be clogged or if not clogged, the atomized liquid may be degraded. In an atomizer such as the example of FIG. 1, the problem is exacerbated by the fact that the slots in the distributor 12 are quite small and easy to plug.

Figure 2:
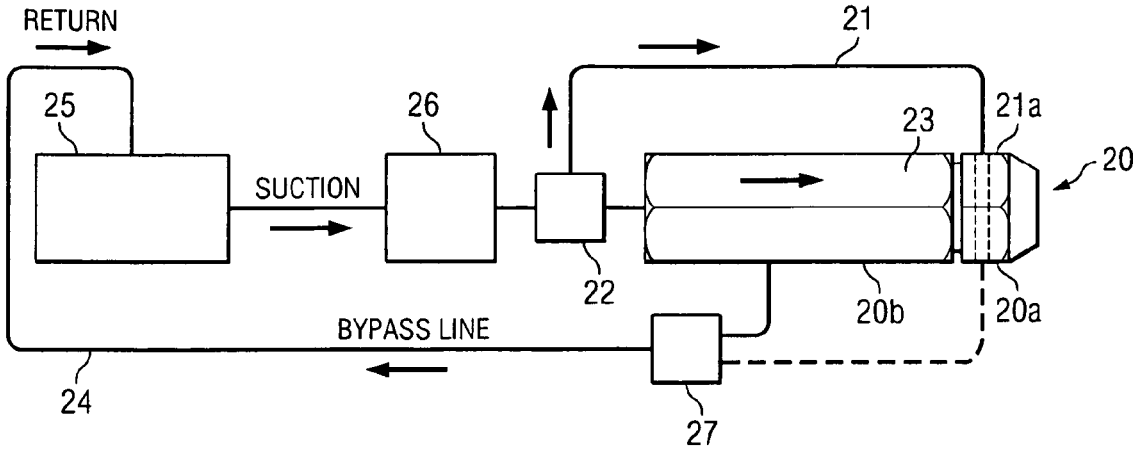
FIG. 2 illustrates the atomizer of FIG. 1 modified in accordance with the invention.

FIG. 2 illustrates the concept proposed herein. The modified atomizer 20 is cooled with the same fluid that is to be sprayed from the atomizer. For cooling, fluid from reservoir 25 is directed to a cooling channel 21, which leads to a annular channel 21*a* machined into adapter 10*b* in the region where the nozzle 10*a* screws into the adapter 10*b*. The fluid in the annular channel 21*a* cools the adapter in the area near the orifice.

As indicated by the dotted lines, if desired, after a heat exchange occurs, the liquid may be directed out of the atomizer via the bypass channel 24. To this end, the annular channel can be made to be in liquid communication with the bypass channel. The circulated liquid flows back into the liquid supply reservoir 25.

The atomizer's normal valve, used to turn off and on liquid flow to the atomizer, and located upstream from the atomizer, is replaced with a 3-way valve 22 which directs flow from a supply pump 26 to either the atomizer spray path 23, in the normal way, or to the cooling channel 21 when the spray is turned off. Thus, depending on the setting of valve 22, the liquid flows in a spray path" 23 when the atomizer is on (spraying), and a cooling path 21 when the atomizer is off (not spraying).

When the spray is stopped (off) and the liquid is circulating within nozzle 10*a* via the cooling channel 21, the atomizer remains relatively cool, below the liquid thermal decomposition point, by its thermal contact with the adapter 10*b*. The standard liquid pump 26 that supplies pressure to the atomizer may be used to cool the atomizer even when the atomizer is not spraying liquid.

In this way, a standard atomizer nozzle 10*a* can be used and replaced as necessary. If the atomizer already has a bypass channel 24, the only modification is to the adapter 10*b* that holds the nozzle 10*a*. In practice, the cooling channel 21 could be bored into the adapter body, or it can be external to the adapter.

If the atomizer does not already have a bypass channel for permitting liquid to exit the circulation chamber, the atomizer may be modified to have an exit channel.

If a high-pressure boost pump (not shown) is used to increase the pressure from a supply pump to improve atomization quality, the 3-way valve 22 may be placed upstream of the high-pressure pump, as even low pressure is sufficient for cooling the atomizer. A check mechanism may be necessary as part of bypass valve 27 to avoid liquid flow backward through the bypass line if the drain is arranged as shown in FIG. 2.

Some existing fuel injectors provide fuel flow through the injectors even when they are not spraying fuel. However, in these injectors, the purpose of the fuel flow is not to cool the injector, but rather, to provide fuel in a convenient location to be injected when required. In those injectors, an expensive solenoid control valve must be built into the fuel injector, greatly increasing the cost.

In general, the modification discussed above is to an atomizer having a housing surrounding the nozzle. In the example of FIGS. 1 and 2, the housing is a removable adapter 10*b*. The housing has an annular channel 21*a* for containing the liquid delivered from the reservoir via the circulation channel. The liquid may enter (or remain in) this annular region even when the spray is turned off and is pressurized by the same pressure used for providing the spray.

Figure 3:
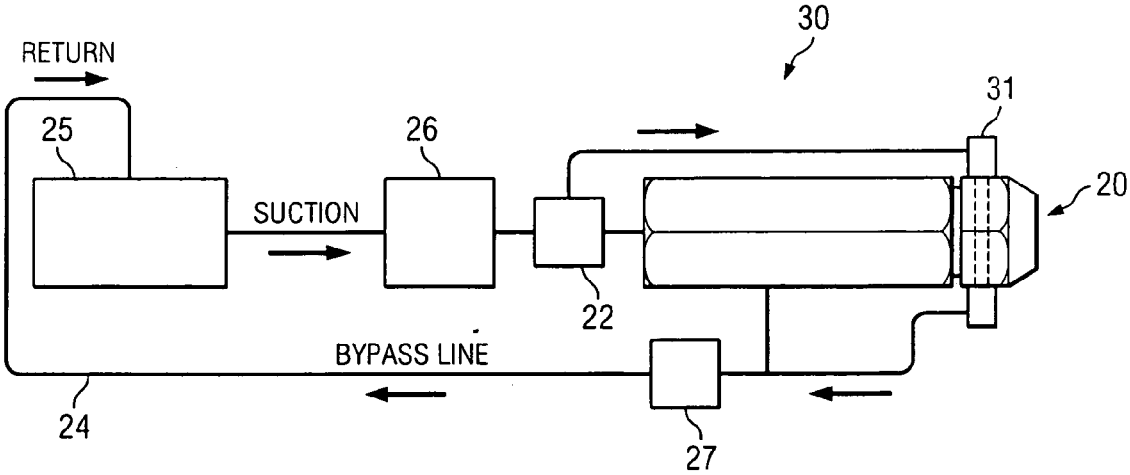
FIG. 3 is second embodiment of an atomizer, modified in accordance with the invention.

FIG. 3 illustrates an alternative embodiment of the invention. A circulation cylinder 31 has been added in the region of the atomizer nozzle. Cylinder 31 permits liquid that is normally sprayed through the atomizer (when the atomizer is "on") to flow through the cylinder 31 on one side of the nozzle and to exit on the other side. The flow of liquid inside cylinder 31 can take many forms. As another example, the liquid can flow around the nozzle.

Cylinder 31 may be easily attached to an existing housing, such as adapter 10*b*. In fact, for purposes of generality, both the embodiment of FIG. 2 and the embodiment of FIG. 3 could be described as having a housing (adapter 10*b* or cylinder 31) having an annular bore around the nozzle 10*a*.

As illustrated in FIG. 3, the discharged liquid can flow out through an existing bypass line 14. Alternatively, for atomizers not already having a bypass line, an exit line can be provided.

Other elements of FIG. 3 are similar to those of like numbering in FIG. 2.

For the embodiments of FIGS. 2 and 3, the modifications described herein allow the atomizer to be used for intermittent operation in a hot environment. Without the modification, the atomizer would suffer from thermal degradation of the liquid in the atomizer and eventual atomizer plugging.

The thermal degradation point for fuels like diesel fuel is above 200° C., so maintaining the atomizer temperature lower than that value should prevent degradation. For urea-water mixtures, the temperature is lower, probably less than 70° C.

What is claimed is:

1. An atomizer for spraying a liquid delivered from a source reservoir, comprising:

a nozzle having an orifice end for emitting liquid in a spray and having a liquid input end opposite the orifice end;

a nozzle housing to which the liquid input end of the nozzle is attached;

an annular channel around the housing near the place of attachment of the nozzle to the housing;

a spray channel for delivering liquid from the reservoir to the orifice;

a circulation channel for delivering liquid from the reservoir to the annular channel; and a three-way valve for controlling whether liquid from the reservoir is delivered to the spray channel or the circulation channel.

2. The atomizer of claim 1, further comprising an exit channel for delivering liquid out of the annular channel.

3. The atomizer of claim 1, wherein the atomizer has a bypass channel and wherein the exit channel is in liquid communication with the bypass channel.

4. The atomizer of claim 1, wherein the nozzle is attached by being inserted into the housing, and wherein the annular channel is around the area of insertion.

5. An atomizer for spraying a liquid delivered from a source reservoir, comprising:

a nozzle having an orifice end for emitting liquid in a spray and having a liquid input end opposite the orifice end;

a nozzle housing to which the liquid input end of the nozzle is attached;

a cooling cylinder around the nozzle, the cylinder having an annular channel;

a spray channel for delivering liquid from the reservoir to the orifice;

a cooling channel for delivering liquid from the reservoir to the annular channel; and a three-way valve for controlling whether liquid from the reservoir is delivered to the spray channel or the cooling channel.

6. The atomizer of claim 5, further comprising an exit channel for delivering liquid out of the annular channel.

7. The atomizer of claim 5, wherein the cooling cylinder permits liquid to flow across the outer surface of the nozzle from one side to the other.

8. The atomizer of claim 5, wherein the cooling cylinder permits liquid to flow around the outer surface of the nozzle.

* * * * *